United States Patent [19]

Bennett et al.

[11] Patent Number: 4,974,643

[45] **Date of Patent: * Dec. 4, 1990**

[54] METHOD OF AND APPARATUS FOR DISPENSING BEVERAGE INTO A TILTED RECEPTACLE WITH AUTOMATIC LEVEL RESPONSIVE SHUT OFF

[75] Inventors: Clay D. Bennett, Payson, Ariz.; Donald E. Holcomb, Brooklyn Center; Henry C. Kovar, Brooklyn Park, both of Minn.

[73] Assignee: The Cornelius Company, Anoka, Minn.

[ * ] Notice: The portion of the term of this patent subsequent to Jun. 28, 2005 has been disclaimed.

[21] Appl. No.: 212,400

[22] Filed: Jun. 27, 1988

Related U.S. Application Data

[63] Continuation-in-part of Ser. No. 824,815, Jan. 31, 1986, Pat. No. 4,753,277.

[51] Int. Cl.[5] ..... B65B 3/04; B65B 3/26

[52] U.S. Cl. ..... 141/1; 141/95; 141/198; 141/360; 141/86; 141/128

[58] Field of Search ..... 141/1, 86, 369, 128; 137/392

[56] References Cited

U.S. PATENT DOCUMENTS

| | | | |
|---|---|---|---|
| 2,639,078 | 5/1953 | Karlen | 141/217 X |
| 3,616,824 | 11/1971 | Orlando | 141/198 |
| 3,916,963 | 11/1975 | McIntosh | 141/198 |
| 4,236,553 | 12/1980 | Reichenberger | 141/198 |
| 4,261,397 | 4/1981 | Guy | 141/1 |
| 4,437,497 | 3/1984 | Enander | 141/1 |
| 4,590,974 | 5/1986 | Mathews | 141/1 |
| 4,641,692 | 2/1987 | Bennett | 141/95 |
| 4,712,591 | 12/1987 | McCann et al. | 141/198 X |
| 4,738,285 | 4/1988 | Belland | 141/1 |
| 4,753,277 | 6/1988 | Holcomb et al. | 141/95 |

FOREIGN PATENT DOCUMENTS

| | | | |
|---|---|---|---|
| 2921663 | 12/1980 | Fed. Rep. of Germany | 141/95 |

*Primary Examiner*—Ernest G. Cusick

*Attorney, Agent, or Firm*—Sten E. Hakanson; Henry C. Kovar

[57] ABSTRACT

A beverage dispenser has a housing, a dispenser head with an electrically conductive combination beverage receptacle actuator lever and dispensed beverage level probe, a control circuit connected to the probe and to a start switch actuatable by the probe and to a solenoid for a beverage valve, and a drip tray and receptacle support wherein the receptacle support is tilted rearward toward the probe to support a tilted receptacle against the probe and keep the lowest part of a tilted receptacle rim against the probe; an improved probe assembly has dielectric journal piece isolating the probe from a body of the dispensing head, and a heater element is provided for the probe and either continuously or intermittently heats the probe to keep it insect free and sanitary.

25 Claims, 5 Drawing Sheets

34
36
44
62
42
45
24
58
46
14
72
52
26
70
34
48
32
44
45
74
56
62
54
52
46
60
68
66
64
78
58
75
48

74
75
70
50

Fig. 5
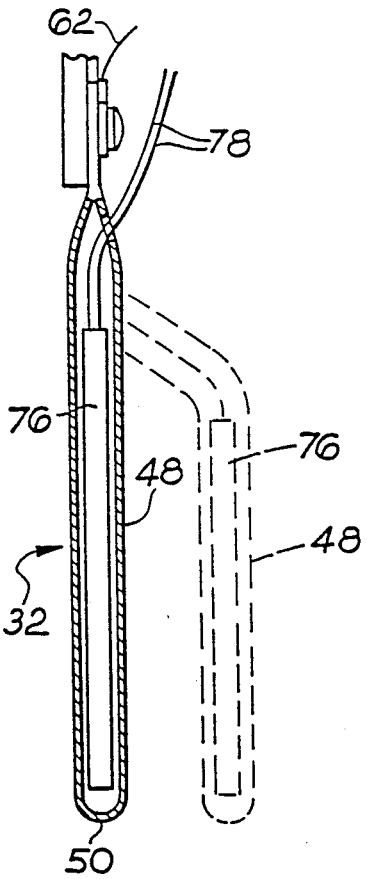
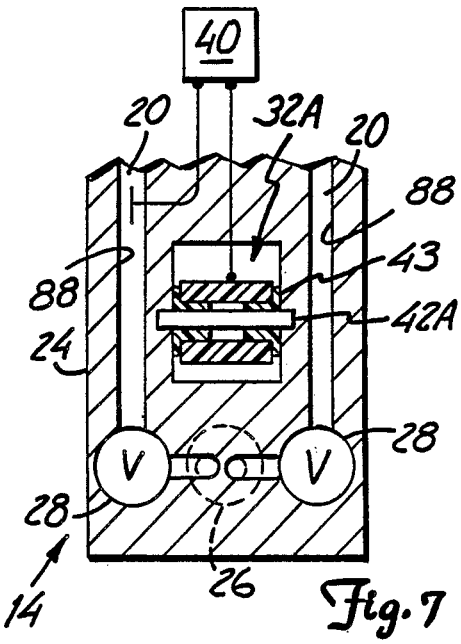
Fig. 7
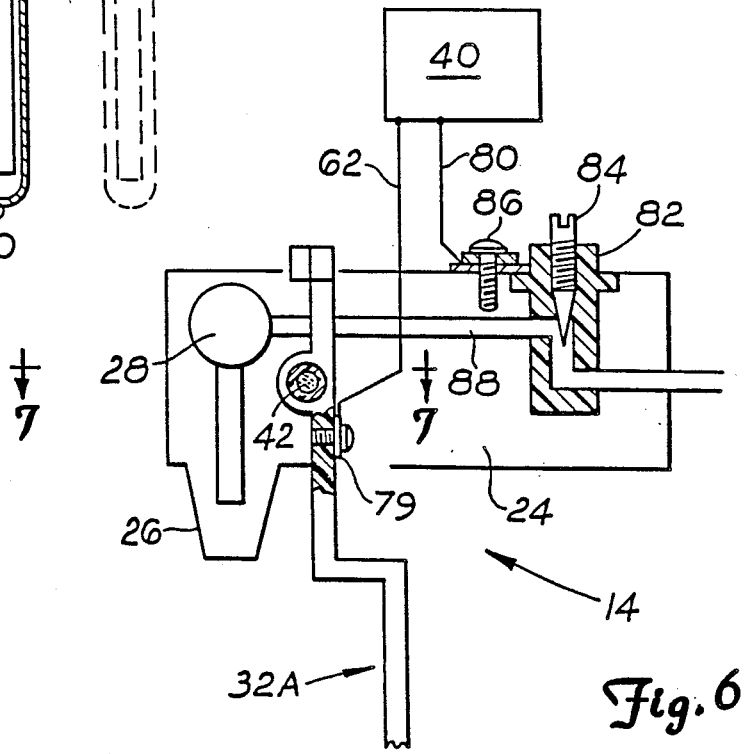
Fig. 6

METHOD OF AND APPARATUS FOR DISPENSING BEVERAGE INTO A TILTED RECEPTACLE WITH AUTOMATIC LEVEL RESPONSIVE SHUT OFF

RELATED APPLICATIONS

This is a co-pending continuation-in-part application based upon U.S. Ser. No. 824,815 filed Jan. 31, 1986, now U.S. Pat. No. 4,753,277 of June 28, 1988.

BACKGROUND OF THE INVENTION

1. Field of the Invention

This invention pertains to a method of and apparatus for dispensing beverage with beverage dispensing head having an electrically conductive probe that senses for dispensed beverage adjacent a lowest rim height in a tilted receptacle and when contacted by beverage in the receptacle passes an electrical signal to a dispensing control circuit that automatically terminates dispensing.

2. The Prior Art

The most relevant known prior art is L. D. McIntosh U.S. Pat. No. 3,916,963 of Nov. 4, 1975, which is owned by The Cornelius Company, assignee of the present invention. McIntosh is the original and first inventor of an automatic beverage dispensing system in which dispensing is started by the placement of a cup under a nozzle and against and into a movable conductive actuator lever, and then automatically terminated when the beverage in the cup reaches and touches the lever. The beverage reaching and touching the lever is sensed via a small electrical potential sent from the nozzle into the cup and then to the lever via the beverage in the cup. McIntosh will probably fill a cup regardless of how much ice is in it, regardless of the diameter of the cup and regardless of variation in the height of the cup.

A. M. Reichenberger U.S. Pat. No. 4,236,553 has application of a voltage potential upon the beverage in the dispensing head, and a conductive cup lever which will accomodate a range of different height cups. A sliding probe dips into the cup and below the rim to sense for beverage.

J. E. Haynes U.S. Pat. No. 3,670,765 has two probes which are inserted into the cup to control a filling level and give automatic shut-off at this level.

H. R. Karlen U.S. Pat. No. 2,639,078 has a coffee machine in which the coffee pot carries a level probe connectible to an electronic shut-off control.

D. Nickerson U.S. Pat. No. 3,839,645 has a two-level electronic fill control using either a short or tall probe inside of a beverage cup.

All of the foregoing have suffered from excessive complexity and the disclosed embodiments have not enjoyed commercial success, save for Karlen. Sanitation of the actuation lever has been a problem, as McIntosh, Reichenberger and the others all require the beverage to contact a conductive member, and insects and the like can land on these members and feed on the residual beverage. Some of the previous levers have been difficult to clean and keep sanitary. Sanitation is becoming more and more important with the re-emergence of draft beer and with the relatively new soft drinks containing high percentages of natural juices. The prior art is not sufficiently sanitary to work with 100 percent juice, high percentage juice soft drinks, or beer. Electrical shunting and feed back are also a problem because of cross-feed from adjacent valves, and because the prior art device must be washed and cleaned very carefully and then completely dried to prevent electrical malfuncions.

Push back of almost empty cups has also been a problem. The prior devices tend to push back an empty cup and then stop dispensing with an almost empty cup. The weight of an empty cup has not been enough to hold the actuator lever back, without the cup being held.

The concept of McIntosh in 1975 was very promising and was very well received, but further invention is needed to attain commercial success.

OBJECTS OF THE INVENTION

It is an object of the present invention to provide a new method of and structure for dispensing beverage into a tilted beverage receptacle with level responsive automatic shut off of dispensing when the dispensed beverage approaches or reaches a lowest level of a tilted receptacle upper rim.

It is an object of the present invention to provide a beverage dispensing head having an improved electrically conductive actuator level for starting and stopping dispensing.

It is an object of the present invention to provide a new and improved actuator lever having a conductive probe, for a beverage dispensing valve.

It is an object of the present invention to provide a beverage dispensing valve actuator lever having a new and improved sanitary and highly reliable construction.

It is an object of the present invention to provide a sanitary beverage dispensing valve actuator having an electrically conductive heated beverage level probe.

It is an object of the present invention to provide a semi-automatic beverage dispensing head with a sanitary conductive plastic actuator lever of reliable and simplified construction.

It is an object of the present invention to provide an improved beverage dispensing valve having an improved structure for applying an electrical potential upon the beverage.

It is an object of the present invention to provide an improved beverage dispenser having structure for holding a cup against an actuator lever.

It is an object of the present invention to provide a sanitary method of dispensing beverage with automatic termination of the dispensing at a precise level in a cup.

These and other objects of the invention will become manifested to those versed in the art upon review of or use of the teachings herein.

SUMMARY OF THE INVENTION

Apparatus for dispensing beverage into an open topped receptacle with automatic shut off of dispensing has a beverage dispensing head, an elongate and electrically conductive dispensed beverage level probe, structure for electrifying dispensed beverage in the receptacle and structure for supporting the receptacle in a tilted attitude with a lowered portion of a receptacle upper rim being adjacent the probe to enable contact of dispensed beverage with the probe.

A method of dispensing beverage into an open topped receptacle has the steps of tilting the receptacle during dispensing with a lowest portion of a receptacle upper rim being adjacent an electrically conductive beverage level probe, electrifying the dispensed beverage and terminating dispensing when the electrified beverage contacts the probe adjacent the lowest portion of the tilted rim of the tilted receptacle.

According to the principles of the present invention, a beverage dispenser head having a nozzle, cup support, solenoid cotrolled valve, and electrical control circuit for the solenoid, has the improvement of a fulcrum in the valve body, an actuator lever extending down from the fulcrum with a dielectric journal mounted to the fulcrum and a conductive probe extending down from the journal, and an electrical lead connected to the probe at a level below the fulcrum.

A combination beverage level probe and dispensing actuator lever for a beverage dispensing head has a dielectric journal piece, an elongate electrically conductive probe secured to the journal piece, and structure or connection of an electrical lead to the probe.

A combination beverage level probe and dispensing actuator lever has an elongate electrically conductive metal tube having a closed upper and lower ends and structure for connection of an electrical lead, and suspension structure for rotatably hanging the tube from a dispensing head.

A beverage head combination beverage level probe and actuator lever has a pivotal suspension structure, a hollow electrically conductive beverage level probe, having a leading edge for engaging a cup rim, an electric resistance heater element inside of the probe, a switch actuator, a first electrical lead from the probe, and a second electrical lead extending out of the probe from the heater.

A beverage dispenser head with a nozzle, cup support, solenoid controlled valve, and electrical control circuit has an improved combination actuation lever and beverage level probe of electrically conductive plastic and a lead from the plastic lever to the control during dispensing.

A beverage dispensing head having a valve body, nozzle, cup support, combination beverage level probe and actuator, and electrical control circuit has the improvement of an electrically conductive plug in the valve body and extending into a beverage passageway, and a source of electric potential connected to the plug.

An automatic shut-off beverage dispenser has a housing, a dispensing head mounted on the housing with the head having a combination beverage level probe and actuator lever, and a drip tray and cup rest having an improved structure for holding the cup against the lever.

A sanitary method of dispensing beverage into a cup and automatically shutting off beverage flow when the cup is filled has the steps of pushing back an actuator lever with a cup, terminating dispensing when the beverage in the cup reaches and makes contact with the lever by sending an electrical signal through the beverage and the lever to a control, withdrawing the cup from the lever, and heating the lever to keep it sanitary.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

BRIEF DESCRIPTION OF THE DRAWINGS

FIG. 5 is the structure of FIG. 3 with an optional heater for sanitation;

FIG. 6 is an elevational side view similar to FIG. 3, but with electrically conductive plastic componentry in the beverage dispensing valve.

FIG. 7 is an sectional view through lines VII—VII of FIG. 6;

AS SHOWN ON THE DRAWINGS

Figure 1:
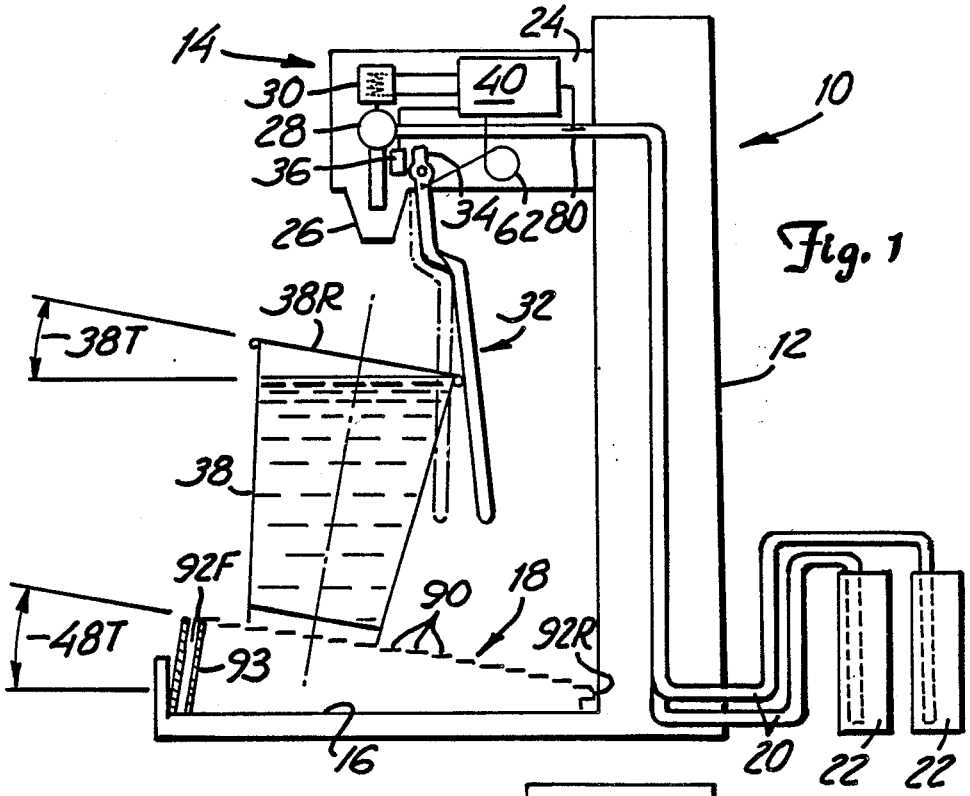
FIG. 1 is an elevational side view of the beverage dispenser of the present invention.

The principles of the present invention are particularly useful when embodied in a beverage dispenser such as shown in FIG. 1 and generally indicated by the numeral 10. The dispenser 10 has a housing 12, at least one and preferrably more beverage dispensing heads each of which is generally indicated by the numeral 14, a drip tray 16, an inclined or tilted receptacle rest 18 and a beverage supply line 20 which is appropriate for connection to a source or sources of beverage 22. The dispensing head 14, which will individually hereinafter simply be referred to as the head 14, is often commonly referred to as a dispensing valve. The most common forms of beverage dispensers 10 have four, five or six discrete heads 14, and up to twelve discrete heads 14 are common. Some dispensers 10 are seen with only one head 14, particularly when used for beer. A specific example of a post-mix beverage head 14 such as used herein is the subject of Forrest Austin U.S. Pat. No. 4,549,675 entitled "Beverage Dispensing Valve". A specific example of a pre-mix, beer or wine beverage head 14 such as used herein is the subject of Forrest Austin et al U.S. Pat. No. 4,708,155. The teachings of these patents is incorprated herein by reference. The head 14, if for post-mix soft drinks will have discrete water and syrup supply lines, even though only a single line is shown as though the head 14 were for beer or pre-mix soft drinks. In a post-mix head 14, the water and syrup are dispensed concurretly, some post-mix heads 14 having one dispensing solenoid and some having two dispensing solenoids connected in parallel to work concurrently.

The head 14 has a valve body generally indicated by the numeral 24, a nozzle 26, at least one and most frequently two normally closed (NC) valves 28 which is or are connected to and are openable by a solenoid 30. The head 14 has a combination beverage level probe and actuator lever generally indicated by the numeral 32 which will hereafter simply be referred to as the probe 32. The probe 32 has a dielectric switch actuator 34 which engages and closes a normally open (NO) switch 36 when the probe 32 is pushed rearward by a beverage receptacle 38. The switch 36 causes the solenoid 30 to become energized to open the valve 28 and start dispensing of beverage into the receptacle 38. A low voltage potential is preferrably applied by an electronic control 40 through a second lead 80 to the beverage supply line 20 and when beverage in the receptacle 38 reaches and makes contact with the lever 32, an electrical signal is sent through the dispensed beverage and the probe 32 by the control circuit 40 which automatically terminates dispensing. This basic device is the subject of and is disclosed in McIntosh U.S. Pat. No. 3,916,963; incorporated hereinto by this reference thereto.

The probe 32 as shown in FIGS. 2–5 is suspended from a fulcrum 42 in the valve body 24 and at a level above the level of the nozzle 26. A dielectric plastic journal piece generally indicated by the numeral 44 has a dielectric hub 45 pivotally suspended on the fulcrum 42 and forms the upper portion of the probe 32. A dielectric front surface 46 of the journal piece 44 abuts against a dielectric backside of the nozzle 26 which gives positive stop and location of the probe 32 with respect to the nozzle 26 as well as providing electrical isolation. The downward extending and electrically conductive part of the probe 32 is a hollow stainless steel metal tube 48 mounted to the journal piece 44. The tube 48 is an elongate length of lightweight hollow tube having its bottom 50 spun and welded shut, and its top end flattened and closed into a mounting flange 52. The flange 52 has a slotted keyway 54 which is precisely fitted to a key 56 on the journal piece 44. A mounting screw 58 is driven through a terminal 60 of a control lead 62, and through an aperature 64 in the flange 52, and into a threaded bore 66 in the lower leg 68 of the journal piece 44 to selectively connect the electrical control lead 62 to the tube 48 and to fasten the control lead 62, and tube 48 to the backside of the journal piece 44. After the screw 58 is driven in and tightened, a dielectric sheath 70 is slipped up and over the lower leg 68, the flange 52, terminal 60 and screw 58 and is shrunk onto the probe 32, flange 52, terminal 60 and screw 58 to positively lock and hold the assembly together and to electrically insulate the top of the tube 48. The probe 32 extends downward out of the valve body 24 through a drain port 72 in a floor of the head 14. The sheath 70 extends through the drain port 72 so that the electrically conductive tube 48 is not exposed in the valve body 24. The lower leg 68 and switch actuator 34 are on opposite sides of the journal piece 44 and are spaced from each other so that the tube 48 is well below all of the fulcrum 42, the switch actuator 34 and the switch 36 so that the electrically conductive tube 48 is electrically isolated from the fulcrum 42. The sheath 70 extends downward to at least the mid level of the nozzle 26 and protects the electrical connection from splashing syrup and water. The lead terminal 60 is fastened to the probe 32 below the fulcrum 42 and the lead 62 runs up past the fulcrum 42. This construction minimizes flexing of the lead 62 and extends the life expectancy. The tube 48 is spaced rearward of the fulcrum 42 and has a rearward directed offset 74 which is to the rear of and below the nozzle 26 and which tends to keep a receptacle 38 spaced below the nozzle 26 so that beverage is not forced up onto the nozzle 26 and into the valve body 24 by a prankster. The tube 48 is very light and exerts minimum forward torque against the receptacle 38. This significantly helps to prevent the receptacle 38 from being pushed forward by the probe 32 and having the dispenser 10 prematurely shut off. The downward extending end of the tube 48 preferrably has a sligtly flattened section which provides a flat leading surface 75 for engagement with the receptacle 38.

In the probe 32 of FIG. 5, an electrical resistance heater element 76 is inside of the tube 48, and a pair of leads 78 from the heater 76 are extended through and out of the tube 48 through an aperture below the flange 52. The heater 76 will heat the tube 48 to a temperature sufficiently high to keep ihsects off and to keep the tube 48 dry, sanitary, and free of contaminants. The heater 76 is spaced well below the valve body 24 so that little, if any, heat gets back to the underbody 24 and beverage for prevention of warm-up and foaming of the beverage. This may enable refilling of glasses, beer mugs and pitchers whereas otherwise new glasses, mugs or pitchers would be required for sanitation reasons. This structure is also particularly well suited for coin-op vending machines.

In FIG. 6, a preferred structure for applying electric potential from control 40 to the beverage is shown. A second lead 80 from the control circuit 40 is connected to a conductive plastic housing 82 of an adjustable beverage volumetric flow rate control valve generally indicated by the numeral 84. The second lead 80 is conductively fastened and connected to the conductive plastic housing 82 by a screw 86 driven into the valve body 24, the screw 86 holds the conductive plastic housing 82 in the valve body 24 to plug an opening leading into the beverage passageway 88. A preferred low cost, lightweight contiguous plastic combination beverage probe and actuator lever 32A is also shown in FIG. 6. The alternative plastic probe 32A and plastic flow control housing 82 are both molded of an electrically conductive FDA approved thermo-plastic such as carbon fiber-filled polycarbonate or nylon.

The preferred plastic probe 32A has a very light downward extending cup engaging portion 75A that is offset to the rear of the fulcrum 42. Again the forward movement of the probe 32A is minimized so that an empty receptacle 38 is not pushed back by the probe 32A. While this alternative probe 32A may not provide the exceptionally high degree of electrical isolation that is provided by the metal probe 32, the preferred probe 32A is lower cost and may be commercially preferrable even though it may not be cleaned with a water spray and left wet as can metal probe 32. The plastic probe 32A may be cored out and may also have a heater 76 in it. The probe lead 62 is connected to the plastic probe 32A by the screw 58 being tightened into an electrically conductive metal insert 79 embedded in the plastic probe 32A. The top of the probe 32A may be dipped in a varnish or similar material to provide a dielectric exterior and electrical isolation from the fulcrum 42 and valve body 24 and nozzle 26.

A preferred structure for suspension of the electrically conductive beverage level probe 32A is best shown in FIG. 7. The valve body 24 is thermoplastic and is kept cold by the beverage being dispensed. Condensate is common on the valve body 24. A dielectric fulcrum pin 42A, which may be ceramic or an engineering resin is utilized and is mounted in and to the valve body 24. The probe 32A is pivotally mounted upon and journaled to the fulcrum pin 42A by one or more dielectric bearings 43 which space and electrically and thermally isolate the probe 32A from the usually moist valve body 24. The dielectic fulcrum pin 42A prevents electric shunting of the control signal though microscopic pin holes, voids or cracks in the valve body 24.

The receptacle rest 18 as shown in FIG. 1 is tilted rearward towards the lever 32 to hold the receptacle 38 in a beverage receiving position biased against and in contact with probe 32. The rest 18 may have transverse grate members 90 that have rear edges that face against the receptacle 38 bottom and tend to hold the receptacle 38 against the probe 32, and hold the receptacle 38 against the push back of the probe 32 so that the biased probe 32 does not push an almost empty receptacle 38 backwards and shut off the dispenser 10. The outer surfaces of the receptacle rest 18 are preferrably dielectric to prevent cross circuitry of the control signal from one dispensing head 14 to another when two or more adjacent heads 14 are concurrently dispensing. The receptacle rest 18 may be nylon coated steel as an example. The receptacle rest 18 has front and rear legs 92F, 92R. Tubular dielectric plastic spacers 93 are secured to the front legs 92F to hold up the front of the receptacle rest 18 and tilt it toward the probe 32. The receptacle support tilt, the grates 90 and the lightweight probe 32 all contribute to enable an almost empty receptacle 38 to hold the probe 32 back.

Referring back to FIG. 1, the receptacle rest or support 18 is shown with a ten degree rearward indication or tilt 18T toward the probe 32. The top rim 38R of the beverage cup or receptacle 38 is likewise tilted rearward toward the probe 32. The receptacle top rim 38R is shown tilted at eleven degrees thirty minutes. The receptacle rest 18 and receptacle are both preferrably tilted at least ten degrees. This rearward tilt 18T of the receptacle support 18 and rearward tilt 38T of the receptacle rim 38R are important aspects of the apparatus and method of this invention.

The tilting of the receptacle 38 in combination with the beverage level sensing probe is shown in detail and can be further explained with reference to FIGS. 8–10 and 11*a* and 11*b*.

Figure 8:
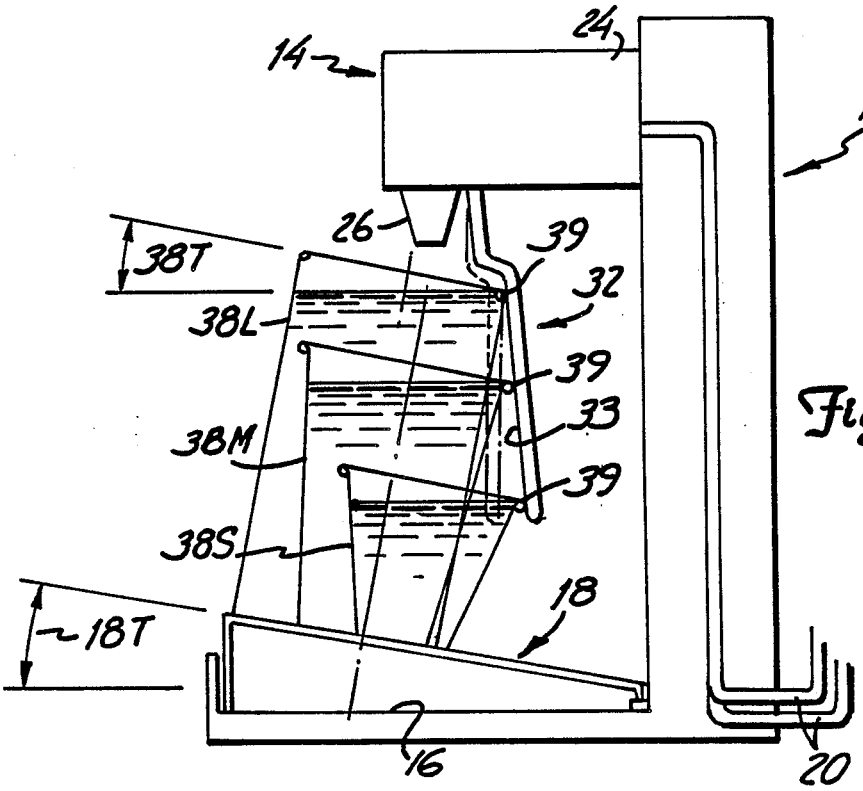
FIG. 8 is an elevational side view of the beverage dispenser of FIG. 1 showing it in use with a variety of different height and volume beverage receptacles.

FIG. 8 shows the dispenser 10, dispensing head 14, receptacle support 18 and beverage level probe 32 of FIG. 1. The beverage receptacle 38 of FIG. 1 is now designated as 38M indicative of medium capacity. A relatively small beverage receptacle is indicated as 38S and a relatively large beverage receptacle is indicated as 38L. All of these receptacles 38S, 38M, 38L work interchangably on the dispenser 10 and is the method of the present invention.

As shown in FIG. 8, many different sizes, shapes and volumes of receptacles 38S, 38M, 38L can be used with the dispenser 10. Each of the receptacles 38S, 38M, 38L is tilted preferrably at least ten degrees by the receptacle support 18. The rim 38R of each receptacle 38 is likewise tilted at least ten degrees into the probe 32 and the lowest level or lowest portion 39 of the respective receptacle rim 38R is biased into contact and held in contact with the conductive front edge or surface 33 of the probe 32. As shown and described with respect to FIG. 1, it is peferred and most simple that dispensing be started in response to movement of the probe 32 by the receptacle. However, for the purposes of this invention, be it understood that dispensing can be started by a discrete push button, non-intrusive receptacle sensor such as an acoustic or light wave emitter/receiver structure, or by a discrete actuator lever (not shown). For the purpose of this invention, any beverage receptacle 38 having an upper rim 38R of the same as or greater diameter than the base diameter, and a height sufficient to reach the bottom of the probe 32 but small enough to go under the nozzle 26 should work. However, the diameter cannot be so large that the receptacle 38 falls off the receptacle support 18. All receptacles 38 are supported at the same angle of tilt 38T by the receptacle rest 18.

Figure 9:
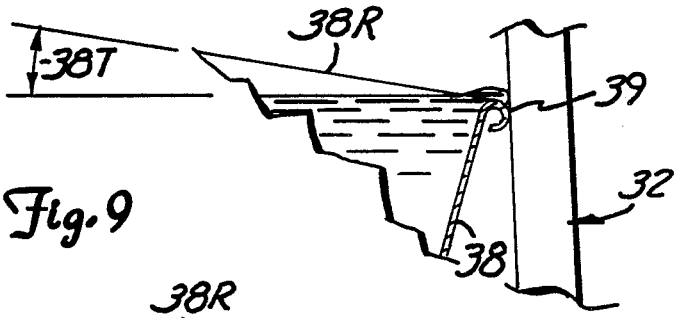
FIG. 9 is an elevational side view in section through the receptacle rim wherein it contacts the beverage level probe.

Referring specifically to FIG. 9, a very important structural and functional aspect of this invention is best shown. As the tilted receptacle 38 is being filled with beverage, the rising level of dispensed beverage in the receptacle 38 eventually approaches and reaches the lowest point 39 of the receptacle rim 38R. The dispensed beverage in the receptacle 38 then climbs up and over the rim low point 39 as clearly shown in detail, makes physical contact with the front surface 33 of .the probe 32. The electrical signal from the control 40 is then transmitted through the electrified dispensed beverage and to the probe 32 and the control 40 responsively shut off the valve 28 and dispensing immediately. In some instances there will be a small overflow over the rim low point due to continued beverage flow during the time lag while the valve 28 actually closes and due to the volume of the beverage in flow between the valve 28 and the receptacle 38 at the time of shut off. It has been found that short receptacles 38S tend to overflow and tall receptacles 38L tend to not overflow. As will be appreciated the in-flow volume of beverage is relatively small with a tall receptacle 38L and relatively large with a short receptacle 38S. We have determined that a tilt angle of thirteen plus or minus two degrees is preferred for the variety of beverage receptacles normally encountered by a given dispenser 10. The probe front surface 33 is shown in FIGS. 1, 3, 5, 6, and 8 is preferrably generally straight as shown and devoid of protuberances. This enables the probe 32 to accomodate any height of receptacle 39 between the shortest and tallest that the particular dispenser 10 is structured to handle.

Figure 10:
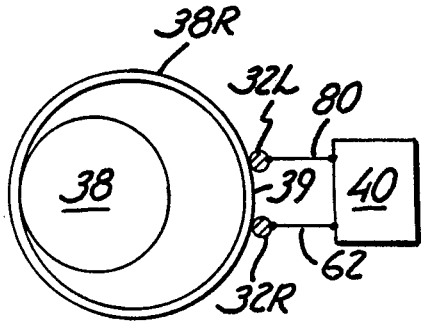
FIG. 10 is a top plan view of the structure of FIG. 1 adapted to use with a double side-by-side probe.

In FIG. 10, a tilted receptacle 38 is shown with the dual side-by-side probe as taught by McIntosh in U.S. Pat. No. 3,916,963. In this example the lowest part 39 of the receptacle rim 38R is in contact with and against the side-by-side probes 32L, 32R which are connected by the respective leads 80, 62 to the control 40. Upon the level of dispensed beverage in the receptacle 38 reaching the rim low point 39, the dispensed liquid in the receptacle makes contact with both probes 32L, 32R and is electrified by one of the probes sending the signal through the dispensed beverage to the other of the probes and effecting automatic shut off of dispensing.

Figure 11A:
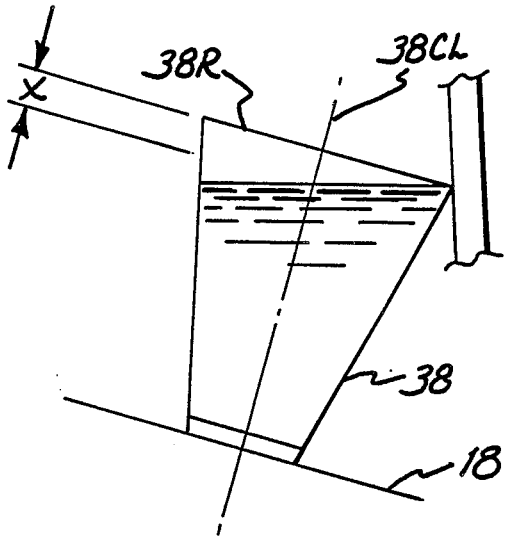
FIG. 11*a* and 11*b* are elevational side views of the filled tilted receptacle and the filled vertical receptacle respectively.
Figure 11B:
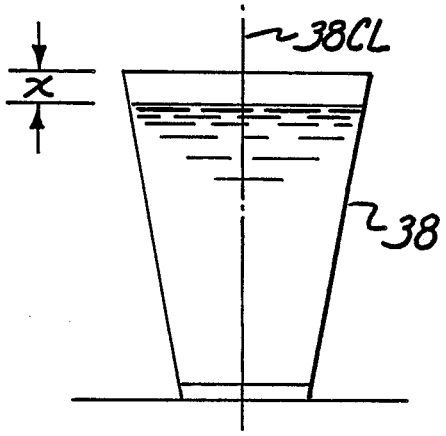

An extremely important benefit of this invention is best shown in FIGS. 11*a* and 11*b*. The receptacle 38 is filled while tilted as shown in FIG. 11*a*. At dispensing shut off, the horizontal level of dispensed beverage in the receptacle will be a predetermined "X" dimension below the rim 38R at the centerline 38CL of the receptacle 38. Most commonly used beverage receptacles 38 have a rim 38R diameter in the range of three to four inches. Therefore "X" can be predetermined to be in the range of 1.5/2.0 tangent of the receptacle support tilt angle 18T. This quantity works to be in the range of ¼ to ½ inch. After the dispenser 10 has automatically shut off, the filled receptacle 38 is removed from the tilted support 18 and placed upon a conventional horizontal surface such as a countertop or a tabletop. The "X" dimension remains the same and the fill height of the dispensed beverage in the cup is visually preceived to be proper each and every time. This predetermined fill level of "X" below the receptacle in 38R is automatically attained regardless of receptacle diameter, height, volume, and regardless of the quantity or absence of ice, and regardless of the dspensing flow rates or the time of dispensing. The predetermined level responsive fill height is always determined by adjustment of the tilt angle of the receptacle rest, predicated on the relationship of $$X = \frac{\text{(Receptacle upper rim diameter)}}{2} \text{ (Tangent of tilt angle)}$$

Figure 2:
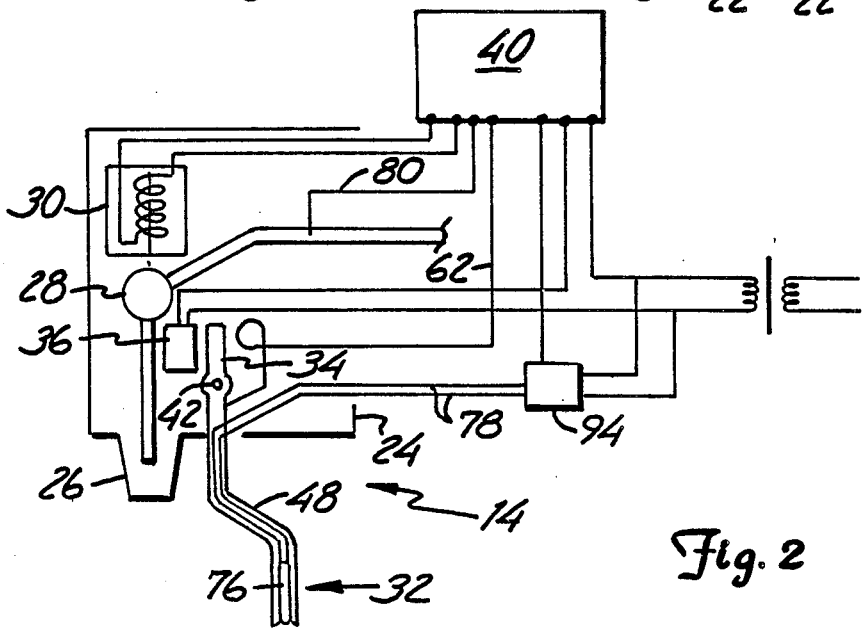
FIG. 2 is a schematic of the electrical circuitry of the structure of FIG. 1.
Figures 3, 4:
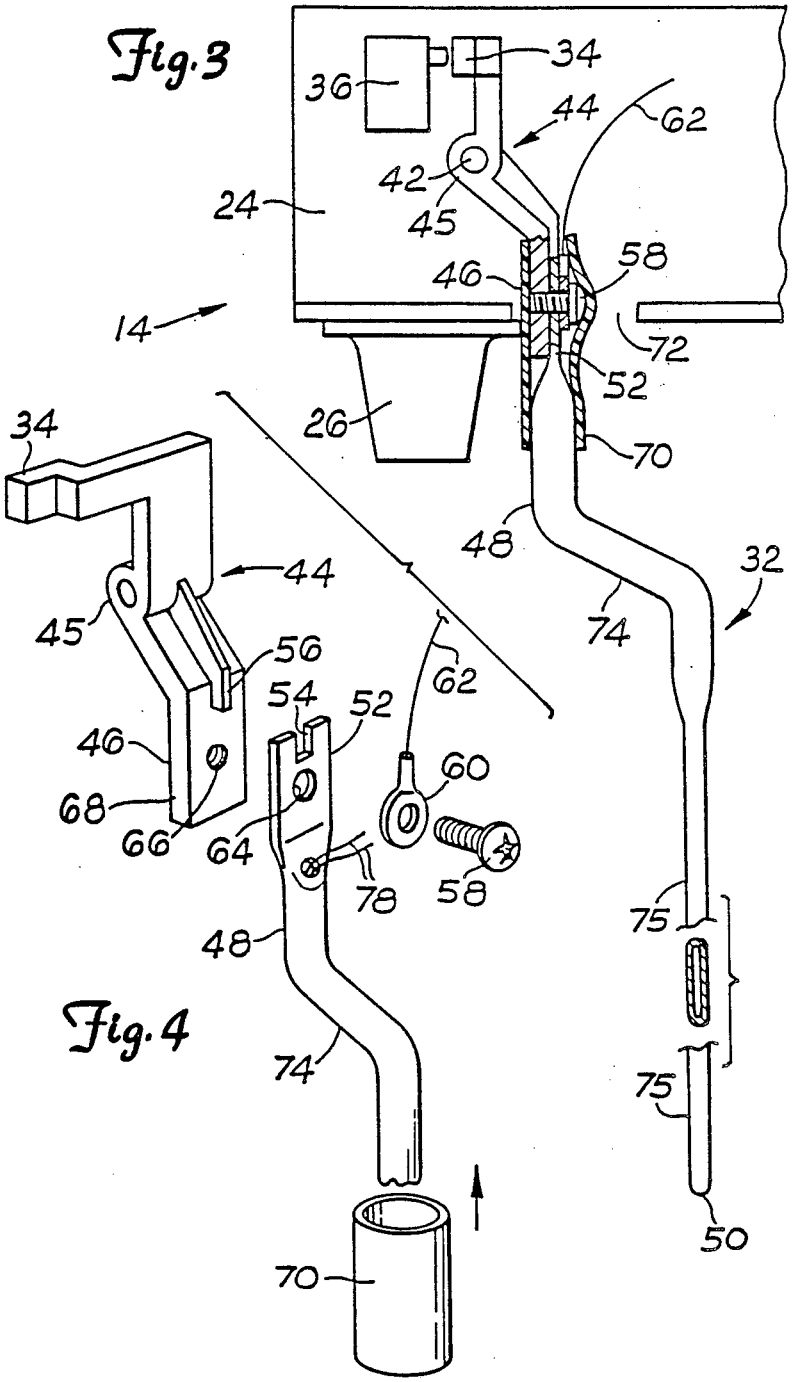
FIG. 3 is an elevational side view detail of the combination beverage probe and actuator lever of the dispenser of FIG. 1.
FIG. 4 is a broken apart view of the structure of FIG. 3.

The circuitry is shown in FIG. 2 wherein the control circuit 40 contains the control logic. Complete circuits are disclosed and explained in McIntosh U.S. Pat. Nos. 3,916,963, Reichenberger U.S. Pat. No. 4,236,553 and Bennett U.S. Pat. No. 4,641,692, the teachings of which are included herein by reference. Briefly, line voltage of about 24 VAC is to be fed to a normally unenergized control 40 through the NO actuator switch 36. The switch 36 closes in response to pivotal movement of the probe 32 and the control 40 becomes energized and effects energization of the solenoid 30 and opening of the NC beverage valves 28 whereupon beverage is dispensed and flows into the receptacle 38. When the beverage in the cup 38 reaches the cup rim and contacts the probe 32, an electrical signal is sent from the second lead 80 through the conductive flow control housing 82, the beverage in the passageway 88 and nozzle 26, and the flowing stream of beverage being dispensed from the nozzle 26 to the receptacle 38, into and through the dispensed beverage in the receptacle 38, and to the probe 32 and then up the first lead 62 to the control 40. When the control 40 receives the signal, the control 40 de-energizes the solenoid 30 and dispensing is automatically terminated. A time time delay can be provided to take into account premature shut-off due to foam or bubbles on top of the real beverage level. Such a delay device is shown in Reichenberger U.S. Pat. No. 4,236,553. The heater 76 can be hooked directly to the supply power and can be continuously energized, or it can be under the control of a control gate 94 that may be a latchable timer, driven by the control 40. At each occurance of dispensing, the heater 76 can be turned on for an appropriate time, and then turned off. If the dispenser 10 has not been used for some time, say an hour, the control 40 may turn off the heater 76 and it may stay turned off overnight until the first dispensing cycle in the morning. The exact criteria for operation of the heater 76 will depend to a great degree upon the environment, the local sanitation agencies, and the operator of the dispenser 10.

Although other advantages may be found and realized and various modifications may be suggested by those versed in the art, it should be understood that we wish to embody within the scope of the patent warranted hereon, all such embodiments as reasonably and properly come within the scope of our contribution to the art.

We claim as our invention:

1. Apparatus for dispensing beverage into an open topped receptacle with automatic shut-off of dispensing when beverage approaches the top of the receptacle, comprising:

(a) a beverage dispensing head having a beverage line with an inlet connectible to a supply of beverage and an outlet nozzle for dispensing of beverage into the receptacle, a normally closed valve in the beverage line, a solenoid operatively connected to open said valve, a dispensing switch operatively connected to activate the solenoid and start dispensing, and an automatic electrical control operatively connected to deactivate the solenoid and terminate dispensing;

(b) an electrically conductive elongate and generally vertical dispensed beverage level probe, said probe being operatively connected to said control during dispensing;

(c) means for electrifYing beverage dispensed into the receptacle, and (d) receptacle support means below the nozzle for supporting an open topped receptacle in a tilted attitude with the lowest portion of a similarly tilted receptacle upper rim being adjacent the probe, so that an electrical signal to terminate dispensing will be sent in a loop through the dispensed beverage and the probe to the control upon the beverage dispensed into the tilted receptacle reaching or approaching the lowest portion of the receptacle rim and making contact with the probe.

2. The apparatus of claim 1, in which said probe is an electrically conductive plastic lever extending downwardly below said nozzle.

3. The apparatus of claim 1, in which said probe is generally vertical, generally straight, and devoid of protuberances toward the receptacle.

4. The apparatus of claim 1, in which the receptacle support means is tilted at least 10 degrees.

5. The apparatus of claim 1, in which the receptacle support means is a rearwardly tilted receptacle rest for engaging the bottom of the receptacle; the tilted plane of the rest being below the probe.

6. The apparatus of claim 1, in which said electrifying means includes an electrical lead from said control and into the beverage line through a body of said dispensing head, and including dielectric means pivotally mounting and suspending said probe in said body for electrically isolating said probe from said body and said electrifying means.

7. The apparatus of claim 1, including electrical heater means in thermal exchange relationship with said probe, so that said probe is electrically heatable to an elevated sanitizing temperature.

8. A method of dispensing beverage into an open topped receptacle comprising the steps of:

(a) providing a supply of beverage at a solenoid operated beverage dispensing head;

(b) placing an open topped beverage receptacle into contact against a generally vertical elongate electrically conductive beverage level probe which is positioned below a nozzle of the dispensing head;

(c) supporting the receptacle in a rearwardly tilted attitude with a receptacle support positioned under the nozzle, with a lowest portion of a similarly tilted receptacle upper rim being adjacent the probe;

(d) starting and continuing dispensing of beverage into the tilted receptacle;

(e) electrifying beverage dispensed into the tilted receptacle;

(f) sending an electrical signal that the tilted receptacle is filled to the lowest point of the tilted rim upon the dispensed beverage reaching the lowest portion of the rim and making contact with the probe, said signal being sent in a loop through the dispensed beverage and the probe to an automatic dispensing shut-off control;

(g) terminating dispensing automatically with the control upon receipt of the signal; and (h) removing the filled tilted receptacle from the receptacle support and placing the filled receptacle upon a generallY horizontal surface and standing the cup upright, whereupon the beverage level in the receptacle shall become generallY parallel to and evenly spaced from the now generally horizontal receptacle rim.

9. The method of claim 8, including the step of engaging the lowest portion of the tilted outer surface of the tilted receptacle rim against the probe during the steps of dispensing and shut off.

10. The method of claim 9, wherein that part of the probe engageable against said rim is devoid of protuberances facing toward the receptacle.

11. The method of claim 8, wherein the receptacle is tilted rearwards at least 10 degrees.

12. The method of claim 8, wherein said receptacle is supported by a rearwardly tilted receptacle rest engaging a bottom of the receptacle, said receptacle rest facing towards the probe.

13. The method of claim 12, including the step of spacing up a front edge of the receptacle rest with at least one spacer installed under said front edge.

14. The method of claim 8, wherein a horizontal upper surface of dispensed beverage is electrified, said upper surface being within the tilted receptacle.

15. An improved method of making a receptacle filling beverage dispenser automatically shut off in response to the actual level of dispensed beverage in an open topped receptacle, having the steps of providing a beverage dispenser with a beverage dispensing head having a body with a beverage line having an inlet connectible to a supply of beverage and an outlet nozzle for dispensing of beverage into the receptacle, a normallY closed valve in the beverage line, a solenoid operatively connected to open said valve, a dispensing switch operatively connected to activate the solenoid and start dispensing, an automatic electrical control operatively connected to deactivate the solenoid and terminate dispensing, and a receptacle rest below the nozzle;

providing an electrically conductive generally elongate and "generally" vertical dispensed beverage level probe below the nozzle and operatively electrically connecting it to said control during dispensing; and providing means for electrifYing the beverage dispensed into the receptacle;

wherein the improvement comprises the further steps of: tilting the receptacle rest rearwards toward the electrically conductive beverage level probe, for supporting a beverage receptacle tilted toward the probe with an upper rim of the receptacle being similarly tilted and having its lowest point proximate to the probe, so that the dispenser will automatically shut off when dispensed beverage reaches the lowest point of the receptacle rim and contacts the probe.

16. The method of claim 15, wherein said receptacle rest is tilted 10 degrees.

17. The method of claim 15, including the steps of spacing up a front edge of a receptacle rest below the nozzle with spacers installed under said front edge, and supporting the tilted receptacle with a bottom of the receptacle resting upon the spaced up and tilted rest.

18. The method of claim 15, including the further step of providing an electric heater in thermal exchange relationship with the probe, for elevating the temperature of the probe and keeping it sanitary.

19. The method of claim 15, including the further step of providing said probe as a plastic electrically conductive probe.

20. The method of claim 15, wherein said probe is movable away from said tilted receptacle rest upon placement of a receptacle on the rest.

21. In combination with a soft drink dispenser of the type having:

a solenoid controlled dispensing valve for discharging liquid into a beverage receptacle placed in a receiving position;

a control unit having probe means for making contact with the liquid dispensed into a receptacle placed in said receiving position when said liquid reaches a predetermined level in said receptacle, first means actuated by movement of a receptacle into said receiving position for actuating said solenoid controlled dispensing valve of said dispenser to discharge liquid into said receptacle and second means actuated by the contact of said liquid in said receptacle with said probe means when said liquid reaches said predetermined level for actuating said solenoid controlled valve of said dispenser to shut off the discharge of liquid; the improvement comprising receptacle support means below the nozzle for supporting the receptacle in a tilted attitude with the lowest portion of a similarly tilted receptacle upper rim being adjacent the probe, so that an electrical signal to terminate dispensing will be sent in a loop through the dispensed beverage and the probe upon the beverage dispensed into the tilted receptacle reaching the predetermined level adjacent the lowest portion of the receptacle rim and making contact with the probe.

22. An automatic dispenser for filling beverage receptacles with liquid having receptacle supporting means for supporting said receptacles in a receiving position to receive said liquid, a liquid dispenser including a nozzle spaced above said supporting means and including a solenoid controlled valve for controlling the dispensing of liquid into a beverage receptacle placed in said receiving position, at least one contact member positioned to make electrical contact with the liquid dispensed into a receptacle in said receiving position when said liquid reaches a predetermined level, means activated bY the placement of a receptacle in receiving position on said supporting means for actuating said solenoid controlled valve to dispense liquid into said receptacle, and control circuit means electrically interconnecting said contact member and said solenoid controlled valve for actuating said valve to stop the dispensing of liquid into a receptacle in said receiving position when the liquid attains said predetermined level in said cup for making electrical contact with said contact member;

wherein said receptacle supporting means comprise structure below the nozzle for supporting an open topped receptacle in a tilted attitude with the lowest portion of a similarly tilted receptacle upper rim being adjacent the probe, so that an electrical signal to terminate dispensing will be sent in a loop through the dispensed beverage and the contact member to the control circuit means upon the beverage dispensed into the tilted receptacle reaching a predetermined level adjacent the lowest part of the tilted receptacle rim and making electrical contact with the contact member.

23. In an apparatus for automatically controlling the flow of liquid dispensed through a solenoid controlled valve into a receptacle placed in a receiving position, said apparatus including first means activated by the placement of said receptacle in said receiving position for initiating the flow of liquid dispensed through said valve and second means including a pair of contact members positioned to establish a path for electrical current therebetween through the liquid dispensed into said receptacle in receiving position when said liquid reaches a predetermined level in said receptacle for activating said valve to shut off the flow of liquid therethrough;

the improvement comprising receptacle support means for supporting an open topped receptacle in a tilted attitude in the receiving position with a lowest portion of a similarly tilted receptacle upper rim being adjacent one of said contact members, so that an electrical signal to terminate dispensing will be sent in a loop through the dispensed beverage and the said one contact member to a shut off control upon the beverage dispensed into the tilted receptacle reaching the predetermined level adjacent the tilted lowest portion of the receptacle rim and making contact with the said one contact member.

24. In a beverage dispenser including:

a nozzle for discharging liquid;

a beverage receptacle supporting means positioned below said nozzle for receiving a receptacle having an upper rim;

a solenoid controlled valve for controlling the discharge of said liquid from said nozzle;

probe means engageable with the rim of said cup for making electrical contact with said liquid dispensed into said cup;

control circuit means electrically connecting said probe means and said solenoid control valve for actuating said valve to stop the dispensing of said liquid into said cup when said liquid attains a predetermined level in said cup; and switch means for activating said solenoid controlled valve to initiate the dispensing of liquid into said receptacle;

the improvement comprising receptacle support means below the nozzle for supporting said beverage receptacle in a tilted attitude with the lowest portion of a similarly tilted said receptacle upper rim being adjacent the probe, so that an electrical signal to terminate dispensing will be sent in a loop through the dispensed beverage and the probe to the control circuit means upon the beverage dispensed into the tilted receptacle reaching the predetermined level adjacent the lowest portion of the tilted receptacle rim and making contact with the probe.

25. In a beverage dispenser for automatically controlling the filling of a receptacle, said dispenser having at least one source of beverage;

at least one valve means for controlling discharge of beverage from said source into the cup to be filled;

actuating means to cause said valve means to be energized to initiate dispensing of the beverage into the receptacle to be filled;

an electrically conductive member associated with the beverage dispenser and disposed to be outside of and adjacent to an upper rim of the receptacle that is being filled;

circuit means for electrically interconnecting said electrically conductive member with dispensed beverage and control means for operating said valve means in response to a change in impedance between said electrically conductive member and the dispensed beverage, when the receptacle has been filled to a pre-determined level, to automatically discontinue beverage flow to the receptacle;

the improvement comprising receptacle support means for supporting an open topped said receptacle in a tilted attitude with the lowest portion of a similarly tilted said receptacle upper rim being adjacent the conductive member, so that an electrical signal to terminate dispensing will be sent in a loop through the dispensed beverage and the conductive member to the control means upon the beverage dispensed into the tilted receptacle reaching the predetermined level adjacent a lowest portion of the tilted receptacle rim and making contact with the conductive member.

* * * * *